US010988833B2

(12) United States Patent
Wang et al.

(10) Patent No.: US 10,988,833 B2
(45) Date of Patent: Apr. 27, 2021

(54) NI—AL-RE TERNARY EUTECTIC ALLOY AND PREPARATION METHOD THEREOF

(71) Applicants: SHANGHAI JIAO TONG UNIVERSITY, Shanghai (CN); ZHONGCHAO HANGYU INVESTMENT CASTING S&T CO., Yixing (CN)

(72) Inventors: Jun Wang, Shanghai (CN); Yun Wu, Shanghai (CN); Maodong Kang, Shanghai (CN); Haiyan Gao, Shanghai (CN); Shuxian He, Shanghai (CN); Yahui Liu, Shanghai (CN)

(73) Assignee: SHANGHAI JIAO TONG UNIVERSITY, Shanghai (CN)

( * ) Notice: Subject to any disclaimer, the term of this patent is extended or adjusted under 35 U.S.C. 154(b) by 0 days.

(21) Appl. No.: 16/630,848

(22) PCT Filed: Oct. 25, 2017

(86) PCT No.: PCT/CN2017/107580
§ 371 (c)(1),
(2) Date: Jan. 13, 2020

(87) PCT Pub. No.: WO2019/024274
PCT Pub. Date: Feb. 7, 2019

(65) Prior Publication Data

US 2020/0157661 A1 May 21, 2020

(30) Foreign Application Priority Data

Aug. 3, 2017 (CN) ..... 201710654283.5

(51) Int. Cl.
*C22C 19/03* (2006.01)
*C22C 1/02* (2006.01)

(52) U.S. Cl.
CPC ..... *C22C 19/03* (2013.01); *C22C 1/023* (2013.01)

(58) Field of Classification Search
None
See application file for complete search history.

(56) References Cited

U.S. PATENT DOCUMENTS

| | | | | |
|---|---|---|---|---|
| 4,121,924 | A * | 10/1978 | de Barbadillo, II | C22C 19/007 420/83 |
| 7,584,778 | B2 | 9/2009 | Song et al. | |
| 7,854,252 | B2 | 12/2010 | Song et al. | |
| 2007/0062669 | A1 | 3/2007 | Song et al. | |

FOREIGN PATENT DOCUMENTS

| | | | |
|---|---|---|---|
| CN | 1073726 | A | 6/1993 |
| CN | 1888109 | A | 1/2007 |
| CN | 101429611 | A | 5/2009 |
| CN | 102011026 | A | 4/2011 |
| CN | 102965551 | A | 3/2013 |
| CN | 106825505 | A | 6/2017 |

OTHER PUBLICATIONS

Wang, First-principles study of NiAl microalloyed with Sc, Y, La and Nd, Computational Materials Science, (Year: 2010).*
ASM Handbook Volum15 Casting: Vacuum Induction Melting (Year: 2008).*
K.G. Swift, Manufacturing Process Selection Handbook Chapter 3—Casting Processes, (Year: 2013).*
J. A. Goebel and S. Rosen, "Phase Equilibria in the Nickel-Aluminum-Scandium System at 1000° C.," J. Less-Common Metals 16 (4), 441-446 (1968). (Year: 1968).*
Bazyleva, O. A., et al. "Rare-earth metals in nickel aluminide-based alloys: III. Structure and properties of multicomponent Ni 3 Al-based alloys." Russian Metallurgy (Metally) 2009.2 (2009): 154-159. (Year: 2009).*
Povarova, K. B., et al. "Rare-earth metals (REMs) in nickel aluminide-based alloys: I. Physicochemical laws of interaction in the Ni—Al-REM and Ni x Al y-REM-AE (alloying element) systems." Russian Metallurgy (Metally) 2008.1 (2008): 46-51. (Year: 2008).*
Povarova, K. B., et al. "Influence of rare-earth metals on the high-temperature strength of Ni 3 Al-based alloys." Russian Metallurgy (Metally) 2011.1 (2011): 47-54. (Year: 2011).*
Internation Search Report of PCT/CN2017/107580, dated May 9, 2018.

* cited by examiner

*Primary Examiner* — Anthony J Zimmer
*Assistant Examiner* — Michael J Kachmarik
(74) *Attorney, Agent, or Firm* — True Shepherd LLC; Andrew C. Cheng

(57) ABSTRACT

A Ni—Al-RE ternary eutectic alloy and a preparation method thereof are provided. The alloy is composed of the following elements by weight percent, aluminum (Al) of 2.50% to 19.50%, rare earth (RE) of 1.30% to 20.0%, other impurity elements being less than or equal to 0.10%, and the rest being nickel (Ni). The microstructure of the alloy is in a completely eutectic form, and the density is 6.8 to 7.1 g/cm$^3$. Raw materials are prepared according to the ratio, and are placed into a vacuum induction smelting furnace; the smelting furnace is vacuumized to $10^{-5}$ Pa, power is increased to ensure complete melting of the raw materials, and the molten alloy melt is poured into an iron mold to obtain alloy ingots. The eutectic phase in the microstructure of the alloy in the disclosure has high hardness.

4 Claims, No Drawings

NI—AL-RE TERNARY EUTECTIC ALLOY AND PREPARATION METHOD THEREOF

TECHNICAL FIELD

The disclosure relates to the field of component design of new material and the preparation thereof, and particularly to the component of a Ni—Al-RE ternary eutectic alloy and the preparation method thereof.

BACKGROUND OF THE PRESENT INVENTION

Rare earths (RE) have always been important strategic resources in China. Overall reserves and production output of the rare earths in China rank first in the world. With the continuous development of the rare earth industry, the industrial chain for rare earth in China has begun to take shape, but still faces the problem of being "big but not strong". The rare earth industry has some prominent problems itself, in which the excess production capacity and weak downstream industries are two major problems. In recent several years, numerous research institutes have engaged in developing new materials containing the rare earths and actually have obtained various achievements, such as the successful application of the rare earths in magnesium alloys and aluminum alloys. However, in order to solve the problems of the rare earth industry as soon as possible, it is required to further develop the novel materials containing the rare earths. The application of nickel-based alloy plays a crucial role in the fields of aerospace, energies, etc. However there is little progress in adding rare-earth elements into the nickel-based alloy. If a great number of rare earths are added into the nickel-based alloy to form the new material with a special function, the crisis of the rare earth industry will be certainly further alleviated.

In order to apply a great number of rare earths to the nickel-based alloy, it is necessary to reasonably design components according to the predetermined direction and strictly control the preparation process so as to ensure that the obtained new material meets the expectation and can be subjected to the subsequent development, thereby finally promoting the application of the rare earths in the nickel-based alloy. How to apply a great number of rare earths to the nickel-based alloy to form the new material with stronger function or performance is a pointcut to break through the bottleneck in the downstream of the rare earth industry. In order to provide more fundamental research data for the development of the rare-earth nickel-based alloy, it is necessary to develop a new nickel-based alloy material containing a great number of rare earths and a preparation process thereof.

It is found after search, Chinese patent application with Publication No. CN106521244A discloses a rare-earth modified, high-Mo and $Ni_3Al$-based single crystal superalloy and a preparation method thereof. The alloy contains components such as Ni, Al, Mo, Re, Ta, Cr, C, Y and Dy or Ce, and as-casted microstructure includes three types of phases, i.e., γ' phase, γ phase and Mo and Re riched white precipitate, and the density is 7.9 to 8.1 g/cm$^3$, and the alloy can reach a completely antioxidant level or an antioxidant level or secondary antioxidant level at 1100° C. The method includes preparing a liquid metal cooling medium, preparing a parent alloy rod material, preparing $Ni_3Al$-based single crystal superalloy seed crystal containing no rare-earth element, preparing high-Mo $Ni_3Al$-based single crystal superalloy containing the rare-earth element by a directional single crystal furnace, and carrying out the later heat treatment. The $Ni_3Al$-based single crystal superalloy provided by the disclosure is low in density, and can meet the low-density requirement of aerospace engines; and the antioxidant performance of the alloy at 1100° C. can reach the completely antioxidant level or antioxidant level or secondary antioxidant level.

However, the above patent application is complicated in components; and moreover, the method for preparing single crystals is used, the preparation process is complicate, defects are not easy to control, and the cost is high.

SUMMARY OF PRESENT INVENTION

Aiming at the defects in the prior art, the present disclosure provides a high-hardness Ni—Al-RE ternary eutectic alloy adopting Ni as a main element and containing Al and one kind of rare earths (RE), and a preparation method thereof, to overcome the difficulty of the application of rare earths in nickel-based alloy.

According to one aspect of the disclosure, a Ni—Al-RE ternary eutectic alloy is provided and composed of the following elements by weight percent, aluminum (Al) of 2.50% to 19.50%, rare earth (RE) of 1.30% to 20.0%, other impurity elements being less than or equal to 0.10%, and the rest being nickel (Ni), and the microstructure of the alloy is in a completely eutectic form.

Preferably, the eutectic form of the Ni—Al-RE ternary eutectic alloy is in a thin laminar shape.

More preferably, the space between slices of the thin laminar shape is in a range of 0.1 to 0.9 micrometer.

Preferably, the weight percent of the Al is 3.50% to 15.00%.

Preferably, the weight percent of the RE is 4.50% to 10.00%.

The Vickers hardness of the Ni—Al-RE ternary eutectic alloy of the disclosure can reach 650 HV which is higher than that of ordinary Ni—Al binary alloy.

On the aspect of the physical properties, the density of the ternary eutectic alloy provided in the present disclosure is 6.8 to 7.1 g/cm$^3$, and is much lower than that of the alloy provided in the background. On the aspect of the microstructure, the alloy provided in the present disclosure has a thin laminar eutectic structure, so it is more advantageous than the existing material in the aspect of the subsequent development of directional performance.

According to another aspect of the disclosure, a preparation method of the Ni—Al-RE ternary eutectic alloy is provided and it includes following steps.

Preparing raw materials according to a ratio, placing the raw materials in a vacuum induction smelting furnace, vacuumizing to ensure that a vacuum degree reaches $10^{-5}$ Pa, increasing the power to ensure complete melting of the raw materials are completely molten, pouring the molten alloy melt into an iron mold, and obtaining alloy ingots.

Preferably, the raw materials comprise aluminum ingots with purity of 99.99% in weight percent, rare earths with purity of 99.99% in weight percent and nickel blocks with purity of 99.99% in weight percent.

Preferably, a magnesia crucible is arranged in the vacuum induction smelting furnace, and the raw materials are held in the magnesia crucible.

Preferably, the step of increasing the power to ensure the complete melting of the raw materials includes increasing the power of a medium-frequency induction furnace gradually; paying special attention to the melting situation of the aluminum; and when the aluminum begins melting, stop increasing the power, wherein the whole alloy material is molten through the reaction between the aluminum and the other two raw materials.

Preferably, the step of pouring the molten alloy melt into the iron mold includes further increasing the power after the raw materials are all molten to ensure good fluidity of the alloy during the pouring; then pouring the alloy melt into the iron mold which is preheated to 150 to 250° C.; and taking out the cast ingots after the alloy melt is cooled, thereby obtaining the ternary alloy.

According to a third aspect of the disclosure, another preparation method of the Ni—Al-RE ternary eutectic alloy is provided and it includes following steps.

Preparing alloy raw materials according to a ratio, placing the prepared alloy raw materials into a water cooling copper crucible of a non-consumable vacuum electric arc furnace, and vacuumizing the non-consumable vacuum electric arc furnace to be below $10^{-5}$ Pa;

Then beginning to introduce argon, and stopping the introduction of argon when the relative pressure displayed on a vacuum pressure gauge is −0.03 to −0.06 Pa;

Striking arc to the alloy raw materials by a tungsten electrode arc gun, increasing the current, and melting the alloy raw materials;

Repeatedly overturning and melting the alloy raw materials for multiple times, then placing the alloy raw materials in the non-consumable vacuum electric arc furnace, cooling the raw materials by the water cooling copper crucible, and taking out to obtain the ternary alloy.

Compared with the prior art, the disclosure has the following beneficial effects.

First, the Ni—Al-RE ternary alloy designed by the disclosure has a completely eutectic structure; an eutectic lamina is very tiny; the space between slices is between 0.1 to 0.9 micrometer, which provides a foundation for further development of the alloy; the alloy can be applied to other solidification processes for production; for example, by adopting a directional solidification process, a directional alloy with a tiny structure can be developed, so that the mechanical performance of the alloy in a single direction can be further improved.

Second, the eutectic phase in the material microstructure in the disclosure has very high hardness, so the overall hardness of the material is high, and the hardness of the alloy is twice of that of the pure Ni—Al binary alloy.

Third, the preparation method of the alloy of the disclosure is simple and efficient; the secondary feeding is not needed; the needed alloy can be obtained by one-step smelting; and the component range is wide, thereby facilitating the industrialized application.

DETAILED DESCRIPTION OF PREFERRED EMBODIMENTS

The disclosure is further described in detail below in combination with specific embodiments. The following embodiments may help those skilled in the art to further understand the disclosure but do not limit the disclosure in any form. It should be pointed out that several modifications and improvements may be made by those ordinary skilled in the art without departing from the concept of the disclosure. These modifications and improvements belong to the protection scope of the disclosure.

A Ni—Al-RE ternary eutectic alloy provided in the disclosure is composed of the following elements by weight percent, aluminum (Al) is 2.50% to 19.50%, rare earth (RE) is 1.30% to 20.0%, other impurity elements is less than or equal to 0.10%, and the rest is nickel (Ni). Microstructure of the alloy is in a completely eutectic form, and the density is 6.8 to 7.1 g/cm$^3$. Preferably, the weight percent of the Al is 3.50% to 15.00%; the weight percent of the RE is 4.50% to 10.00%. Alternatively, the weight percent of the Al is 9.50% to 12.50%, and the weight percent of the RE is 4.50% to 8.50%. As long as the components are selected in the above proportion range, the purpose of the disclosure can be realized.

For the design of the alloy, the components of the ternary alloy of a eutectic composition may be designed by adopting OpenCalphad phase diagram calculation software and a known Ni—Al-RE ternary liquidus projection phase diagram. Since the rare-earth elements have similar physical and chemical properties, the Ni—Al-RE ternary alloy designed by the disclosure has universality, RE can be replaced by various rare-earth elements, i.e. the RE may be any one or more of the rare-earth elements.

The Ni—Al-RE ternary eutectic alloy is prepared as follows. The needed raw materials are prepared according to the component ratio, the prepared raw materials are placed in a medium-frequency vacuum induction smelting furnace, and are carried in a magnesia crucible, the pressure is vacuumized to be less than $10^{-5}$ Pa by starting a Roots pump and a diffusion pump, the power of the medium-frequency induction furnace is gradually increased, special attention is paid to the melting situation of the aluminum, when the aluminum begins melting, the power is no longer increased, and the whole alloy material is melt through the reaction between the aluminum and the other two raw materials. After the alloy is all molten, the power is increased again to ensure the fluidity of the alloy during the pouring, then the molten alloy is poured into an iron mold which is preheated to 200° C., and after the alloy melt is cooled, cast ingots are taken out to obtain the ternary alloy.

Alternatively, the Ni—Al-RE ternary eutectic alloy may also be made through the following preparation method. The raw materials are placed into a water cooling copper crucible of a non-consumable vacuum electric arc furnace, a mechanical pump and a molecular pump are successively started to vacuumize the furnace to be less than $10^{-5}$ Pa, then argon is introduced until the relative pressure displayed on a vacuum pressure gauge is −0.03 to −0.06 Pa, a power supply is switched on to enable a tungsten electrode arc gun to strike arc to the alloy material, the current is increased to melt the alloy material, and the alloy material is repeatedly overturned and melt for multiple times, the alloy material is placed in the non-consumable vacuum electric arc furnace to be cooled by the water cooling copper crucible, and then the ternary alloy can be obtained.

The alloy of the disclosure and the preparation method thereof will be further explained below through specific embodiments.

Embodiment 1

Pure aluminum of 99.99% weight percent, pure yttrium of 99.9% weight percent and pure nickel of 99.99% weight percent are selected and placed in a magnesia crucible of a medium-frequency vacuum induction smelting furnace according to the designed components, wherein Al is 5.5% by weight, Y is 4.5% by weight, and the rest is Ni.

A Roots pump and a diffusion pump are successively started to vacuumize the furnace to be less than $10^{-5}$ Pa. The power of the medium-frequency induction furnace is gradually increased, while special attention should be paid to the melting situation of the aluminum, and the increase of the power should be stopped when the aluminum begins melting.

After the alloy is all molten, the power can be increased again, and then the alloy melt is poured into the iron mold which is preheated to 200° C.

After the alloy melt is cooled, the cast ingots can be taken out to obtain the ternary alloy.

Through the observation of an optical microscope and a scanning electron microscope, the microstructure of the alloy is completely eutectic of tiny laminae, and by virtue of Vickers hardness test, the alloy hardness can reach 650 HV.

Embodiment 2

Pure aluminum of 99.99% weight percent, pure yttrium of 99.9% weight percent and pure nickel of 99.99% weight percent are selected and these raw materials are placed in a water cooling copper crucible of a non-consumable vacuum electric arc furnace according to the designed components, wherein Al is 3.5% by weight, Y is 4.5% by weight, and the rest is Ni.

A mechanical pump and a molecular pump are successively started to vacuumize the furnace to be less than $10^{-5}$ Pa. Then argon is introduced until the relative pressure displayed on a vacuum pressure gauge is −0.04 Pa.

A power supply is switched on to enable a tungsten electrode arc gun to strike arc to the raw materials of the alloy, and the current is increased to melt the alloy materials.

The alloy materials are repeatedly overturned and melt for 4 times and then placed in the water cooling copper crucible for cooling, and the ternary alloy can be obtained.

Through the observation of an optical microscope and a scanning electron microscope, the microstructure of the alloy is completely eutectic of tiny laminae, and by virtue of Vickers hardness test, the alloy hardness can reach 620 HV.

Embodiment 3

Pure aluminum of 99.99% weight percent, pure yttrium of 99.9% weight percent and pure nickel of 99.99% weight percent are selected and placed in a magnesia crucible of a medium-frequency vacuum induction smelting furnace according to the designed components, wherein Al is 19.5% by weight, Y is 15% by weight, and the rest is Ni.

A Roots pump and a diffusion pump are successively started to vacuumize the furnace to be less than $10^{-5}$ Pa. The power of the medium-frequency induction furnace is gradually increased, while special attention should be paid to the melting situation of the aluminum, and the increase of the power should be stopped when the aluminum begins melting.

After the alloy is all molten, the power can be increased again, and then the alloy melt is poured into the iron mold which is preheated to 250° C. After the alloy melt is cooled, the cast ingots can be taken out to obtain the ternary alloy.

Through the observation of an optical microscope and a scanning electron microscope, the microstructure of the alloy is completely eutectic of tiny laminae, and by virtue of Vickers hardness test, the alloy hardness can reach 650 HV.

Embodiment 4

Pure aluminum of 99.99% weight percent, pure yttrium of 99.9% weight percent and pure nickel of 99.99% weight percent are selected and placed in a magnesia crucible of a medium-frequency vacuum induction smelting furnace according to the designed components, wherein Al is 2.5% by weight, Y is 1.5% by weight, and the rest is Ni.

A Roots pump and a diffusion pump are successively started to vacuumize the furnace to be less than $10^{-5}$ Pa. The power of the medium-frequency induction furnace is gradually increased, while special attention should be paid to the melting situation of the aluminum, and the increase of the power should be stopped when the aluminum begins melting.

After the alloy is all molten, the power can be increased again, and then the alloy melt is poured into the iron mold which is preheated to 150° C. After the alloy melt is cooled, the cast ingots can be taken out to obtain the ternary alloy.

Embodiment 5

Pure aluminum of 99.99% weight percent, pure cerium of 99.9% weight percent and pure nickel of 99.99% weight percent are selected and placed in a magnesia crucible of a medium-frequency vacuum induction smelting furnace according to the designed components, wherein Al is 12.5% by weight, Ce is 11.5% by weight, and the rest is Ni.

A Roots pump and a diffusion pump are successively started to vacuumize the furnace to be less than $10^{-5}$ Pa. The power of the medium-frequency induction furnace is gradually increased, while special attention should be paid to the melting situation of the aluminum, and the increase of the power should be stopped when the aluminum begins melting.

After the alloy is all molten, the power can be increased again, and then the alloy melt is poured into the iron mold which is preheated to 200° C. After the alloy melt is cooled, the cast ingots can be taken out to obtain the ternary alloy.

Through the observation of an optical microscope and a scanning electron microscope, the microstructure of the alloy is completely eutectic of tiny laminae, and by virtue of Vickers hardness test, the alloy hardness can reach 620 HV.

Embodiment 6

Pure aluminum of 99.99% weight percent, pure lanthanum of 99.9% weight percent and pure nickel of 99.99% weight percent are selected and placed in a magnesia crucible of a medium-frequency vacuum induction smelting furnace according to the designed components, wherein Al is 10.5% by weight, La is 12.5% by weight, and the rest is Ni.

A Roots pump and a diffusion pump are successively started to vacuumize the furnace to be less than $10^{-5}$ Pa. The power of the medium-frequency induction furnace is gradually increased, while special attention should be paid to the melting situation of the aluminum, and the increase of the power should be stopped when the aluminum begins melting.

After the alloy is all molten, the power can be increased again, and then the alloy melt is poured into the iron mold which is preheated to 150° C. After the alloy melt is cooled, the cast ingots can be taken out to obtain the ternary alloy.

Embodiment 7

Pure aluminum of 99.99% weight percent, pure gadolinium of 99.9% weight percent and pure nickel of 99.99% weight percent are selected and placed in a magnesia crucible of a medium-frequency vacuum induction smelting furnace according to the designed components, wherein Al is 9.5% by weight, Gd is 8.5% by weight, and the rest is Ni.

A Roots pump and a diffusion pump are successively started to vacuumize the furnace to be less than $10^{-5}$ Pa. The power of the medium-frequency induction furnace is gradually increased, while special attention should be paid to the melting situation of the aluminum, and the increase of the power should be stopped when the aluminum begins melting.

After the alloy is all molten, the power can be increased again, and then the alloy melt is poured into the iron mold which is preheated to 150° C. After the alloy melt is cooled, the cast ingots can be taken out to obtain the ternary alloy.

Embodiment 8

Pure aluminum of 99.99% weight percent, pure praseodymium of 99.9% weight percent and pure nickel of 99.99% weight percent are selected and placed in a magnesia crucible of a medium-frequency vacuum induction smelting furnace according to the designed components, wherein Al is 9.5% by weight, Pr is 11.5% by weight, and the rest is Ni.

A Roots pump and a diffusion pump are successively started to vacuumize the furnace to be less than $10^{-5}$ Pa. The power of the medium-frequency induction furnace is gradually increased, while special attention should be paid to the melting situation of the aluminum, and the increase of the power should be stopped when the aluminum begins melting.

After the alloy is all molten, the power can be increased again, and then the alloy melt is poured into the iron mold which is preheated to 150° C. After the alloy melt is cooled, the cast ingots can be taken out to obtain the ternary alloy.

The Ni—Al-RE ternary alloy provided in the disclosure has a completely eutectic structure; the eutectic lamina is very tiny; the space between slices is between 0.1 to 0.9 micrometer; for example, the ternary alloy can be applied to other solidification processes; and when a directional solidification process is adopted, the directional alloy with a tiny structure can be developed, so that the mechanical performance of the alloy in a single direction can be further improved. The overall hardness of the Ni—Al-RE ternary alloy material of the disclosure is high and is twice of that of the pure binary Ni—Al alloy. The preparation method is simple and efficient; no secondary feeding is needed; the needed alloy can be obtained by one-step smelting; and the component range is wide, thereby facilitating the industrialized application.

The specific embodiments of the disclosure are described above. It should be understood that the disclosure is not limited to the specific embodiments, and the purpose of the disclosure may be realized by adjusting the component ratio and preparation process of the alloy. Those skilled in the art can make various modifications or changes within the scope of the claims without influencing the substantive content of the disclosure.

We claim:

1. A method for preparing a Ni—Al-RE ternary eutectic alloy composed of following elements by weight percent: aluminum (Al) of 2.50% to 19.50%, rare earth (RE) of 1.30% to 20.0%, other impurity elements being less than or equal to 0.10%, and the rest being nickel (Ni), comprising:

preparing raw materials according to a ratio, placing the raw materials in a vacuum induction smelting furnace, vacuumizing to ensure that a vacuum degree reaches 10– Pa, increasing power to ensure complete melting of the raw materials so as to form a molten alloy melt, pouring the molten alloy melt into an iron mold, and obtaining alloy ingots that are formed of the Ni—Al-RE ternary eutectic alloy in a completely eutectic form.

2. The method according to claim 1, wherein a magnesia crucible is arranged in the vacuum induction smelting furnace, and the raw materials are held in the magnesia crucible.

3. The method according to claim 1, wherein the increasing the power to ensure the complete melting of the raw materials means that increasing the power of a medium-frequency induction furnace and when the aluminum begins melting, stop increasing the power; wherein the whole alloy material is molten through a reaction between the aluminum and the other two raw materials of the RE and the Ni.

4. The method according to claim 1, wherein the pouring the molten alloy melt into the iron mold means that further increasing the power after the raw materials are all molten to ensure good fluidity of the alloy during the pouring; then pouring the alloy melt into the iron mold which is preheated to 150 to 250° C.; and taking out the cast ingots after the alloy melt is cooled, thereby obtaining the ternary alloy.

* * * * *